US006615747B2

(12) United States Patent
Stenftenagel et al.

(10) Patent No.: US 6,615,747 B2
(45) Date of Patent: Sep. 9, 2003

(54) MODULAR WORKSTATION

(75) Inventors: Mark Stenftenagel, Elmhurst, IL (US); Salvatore Graziano, Western Springs, IL (US)

(73) Assignee: Rieke Office Interiors, Elgin, IL (US)

( * ) Notice: Subject to any disclaimer, the term of this patent is extended or adjusted under 35 U.S.C. 154(b) by 0 days.

(21) Appl. No.: 09/973,649

(22) Filed: Oct. 9, 2001

(65) Prior Publication Data

US 2003/0067256 A1 Apr. 10, 2003

(51) Int. Cl.[7] ..... A47B 13/00
(52) U.S. Cl. ..... 108/159; 312/196
(58) Field of Search ..... 108/50.01, 50.02, 108/60, 159; 312/194, 195, 196; 135/96, 137; 5/131, 400, 282.1, 286

(56) References Cited

U.S. PATENT DOCUMENTS 2,821,450 A * 1/1958 Knoll ..... 108/60
3,873,170 A * 3/1975 Scheerhorn et al. ..... 312/280
3,931,771 A * 1/1976 Kramer ..... 108/77
4,029,024 A * 6/1977 Klitzky ..... 108/60
4,195,882 A * 4/1980 Daswick et al. ..... 297/242
4,612,863 A * 9/1986 Vonhausen et al. ..... 108/28
4,883,330 A * 11/1989 Armstrong et al. ..... 312/195
D405,981 S * 2/1999 Alexaners et al. ..... D6/426
5,947,034 A * 9/1999 Belka et al. ..... 108/50.01
D422,429 S * 4/2000 Belka et al. ..... D6/421
6,202,567 B1 * 3/2001 Funk et al. ..... 108/50.01

* cited by examiner

*Primary Examiner*—Lanna Mai
*Assistant Examiner*—Jerry A. Anderson
(74) *Attorney, Agent, or Firm*—Barnes & Thornburg

(57) ABSTRACT

A modular workstation comprising a plurality of abutting arcuate bases. Each base is comprised of a pair of spaced, parallel inner and outer panel segments oriented generally vertically, with the inner panel segment being offset vertically in relation to the outer panel segment. A web extends between the two panel segments, and the panel segments and the web comprise a unitary body. A series of the bases are joined together, and a generally horizontal worksurface is provided, supported on the inner panel segments. A plurality of legs supports the bases at a predetermined elevation. A reference shelf and privacy canopy can be included in the workstation.

16 Claims, 14 Drawing Sheets

MODULAR WORKSTATION

BACKGROUND OF THE INVENTION

This invention relates to modular workstations, and in particular to a modular workstation composed of at least one, and preferably a plurality of, end-abutting arcuate bases that are supported at a predetermined elevation by a series of legs, and having a generally horizontal worksurface mounted on the bases.

Modular office stations have become common, both due to the cost as apposed to an office with fixed walls, as well as versatility due to relative ease in reconfiguration.

Modular office stations, often called "cubicles", suffer their own deficiencies, however. First, although they are relatively simple to reconfigure in relation to tearing down existing walls and building new walls, nevertheless reforming cubicles can be time consuming and labor intensive. Also, cubicles are generally composed of a myriad of parts, which therefore requires an inventory of parts to be available in order to facilitate reconfiguration. That, however, leads to a high cost of maintaining an inventory of parts, as well as the cost of storage space for those parts. The more sophisticated and complex the parts become, the more costly is reconfiguration, and the greater the chances that only a very few people can handle reconfiguration, due to training and knowledge required.

SUMMARY OF THE INVENTION

The invention relates to a modular workstation, which in its simplest form is composed of an arcuate base comprising a pair of spaced, parallel inner and outer panels segments. The panel segments are oriented generally vertically and the inner panel segment is offset in relation to the outer panels segment. A web extends between the panel segments, with the panel segments and the web comprising a unitary body. A generally horizontal worksurface is supported on the inner panel segment and abuts the outer panel segment. A plurality of legs is provided, supporting the base and the worksurface at a predetermined elevation. The legs are appropriately secured to the base or the worksurface.

In the preferred form of the invention, a plurality of abutting arcuate bases is provided, with means joining each of the abutting arcuate bases. Preferably the joining means comprises a bracket bridging each pair of abutting arcuate bases, with the bracket being secured to the outer panel segments of each of the pairs of abutting arcuate bases. In accordance with the preferred form of the invention, the bracket is shaped for insertion of one of the legs.

Preferably, the number of legs is no greater than the number of arcuate bases, plus one. Thus, as the number of bases is increased, the number of legs commensurately decreases.

A utility channel is provided proximate a lower edge of each inner panel segment, for neatly retaining cables, wires and other similar items. A utility access is also provided for passage of cables, wires and the like in the worksurface, the inner panels and the web.

The modular workstation can include one or more reference shelves spaced above the worksurface. Each reference shelf is mounted on the outer panels segments. A privacy canopy can be provided, also mounted on the outer panel segments. The canopy preferably is retractable.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
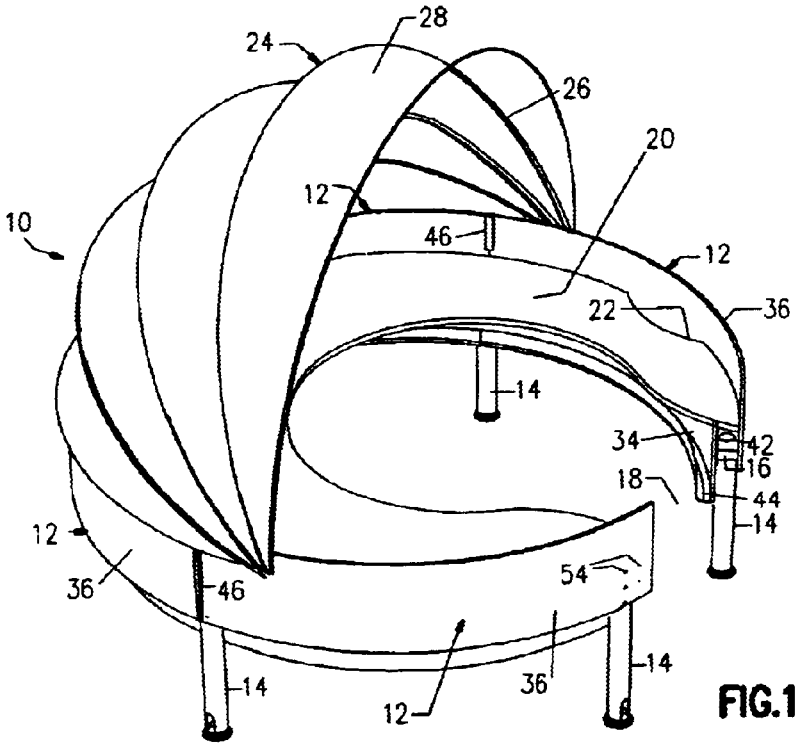
FIG. 1 is a perspective view of a full modular workstation according to the invention, including a retractable canopy.
Figure 2:
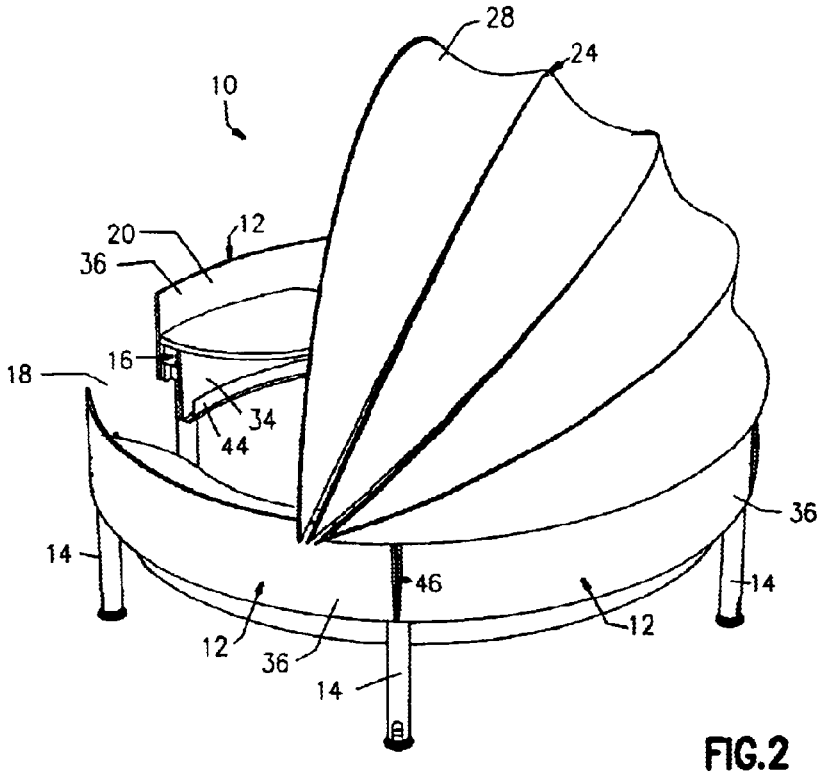
FIG. 2 is a rear perspective view of the workstation of FIG. 1.
Figure 3:
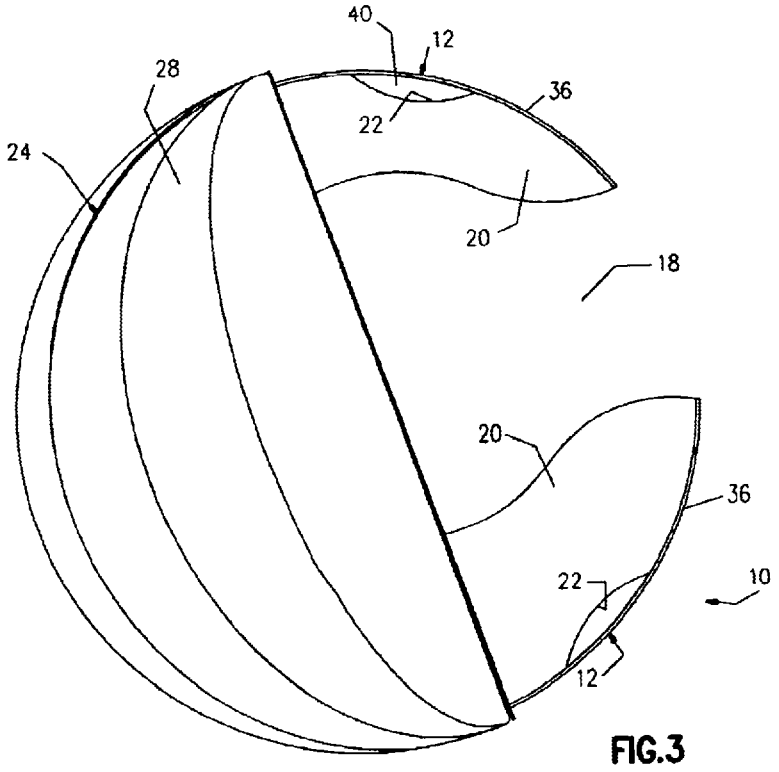
FIG. 3 is a top plan view of the workstation of FIG. 1.
Figure 4:
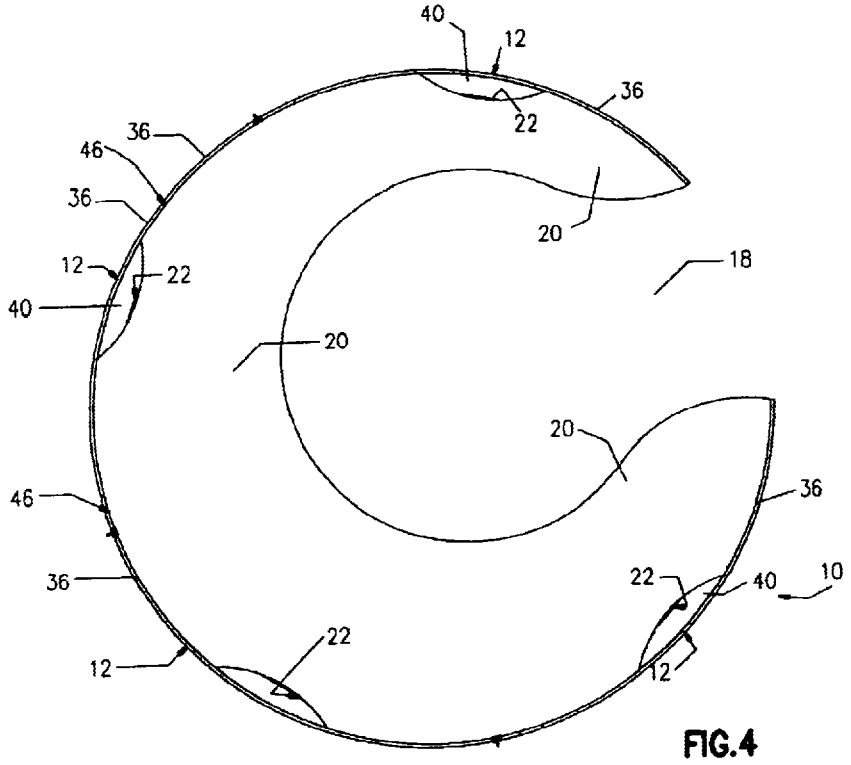
FIG. 4 is a top plan view of a full modular workstation of FIG. 1, without the retractable canopy.
Figure 5:
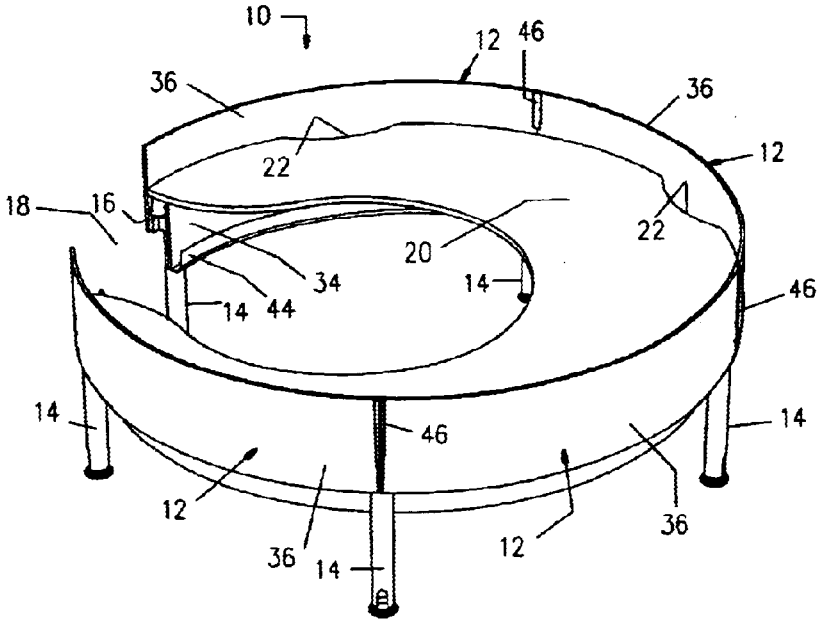
FIG. 5 is a perspective view the workstation of FIG. 4.
Figure 6:
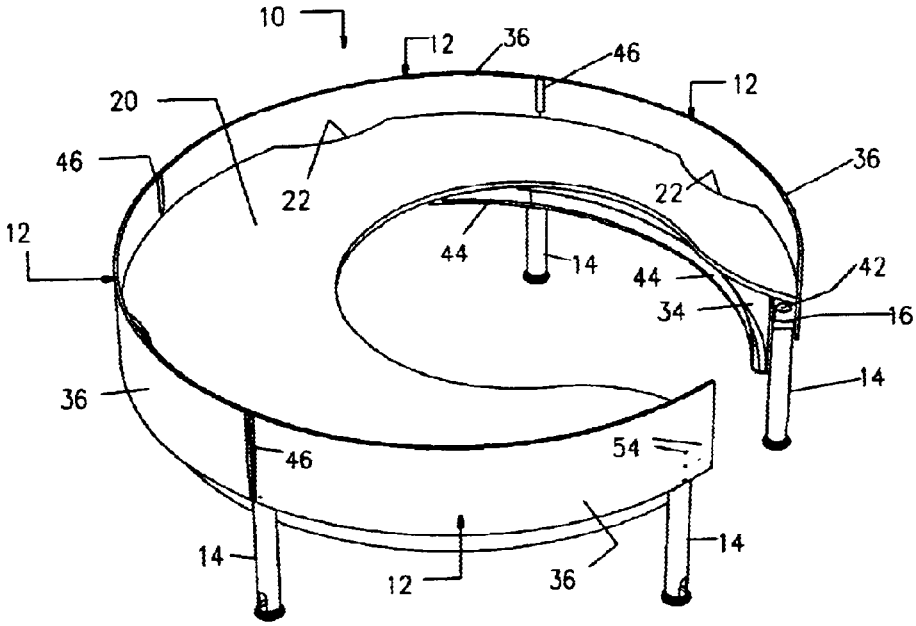
FIG. 6 is a further perspective view of the workstation of FIG. 4, from the opposite side.
Figure 7:
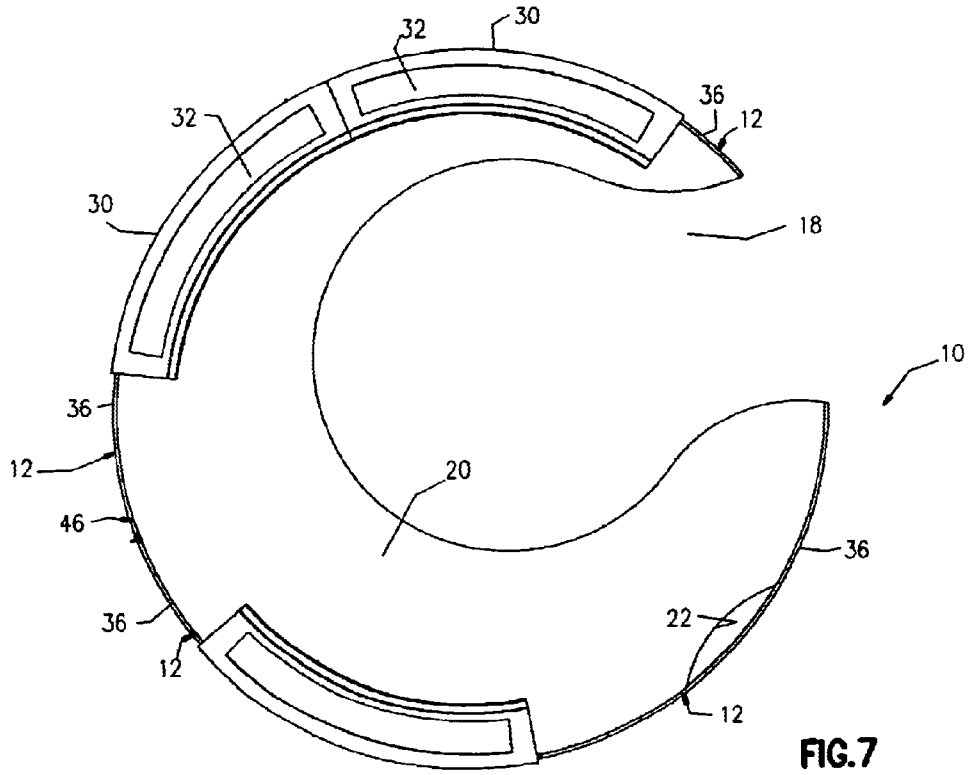
FIG. 7 is a top plan view of a full modular workstation according to the invention, including three shelves.
Figure 8:
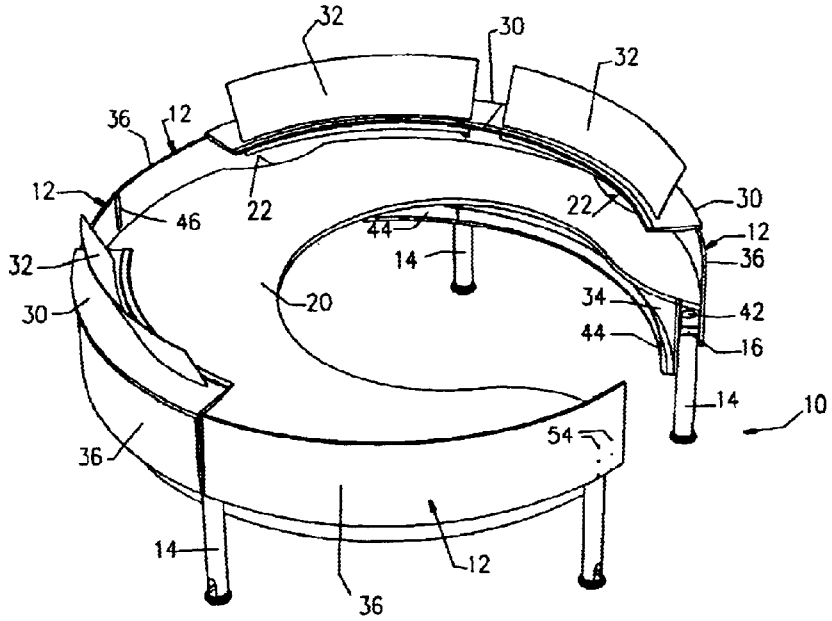
FIG. 8 is a perspective view of the workstation of FIG. 7.
Figure 9:
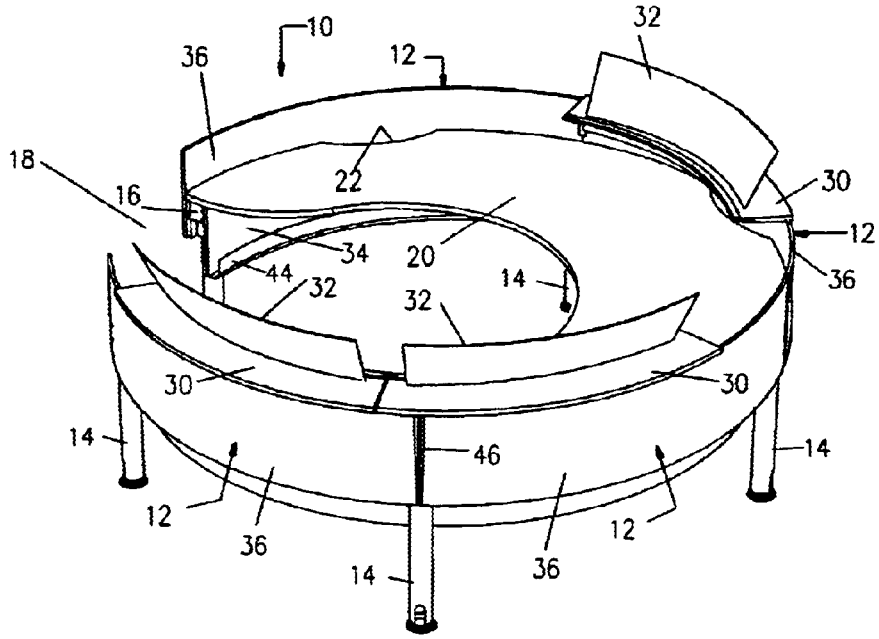
FIG. 9 is a further perspective view of the workstation of FIG. 7, from the side opposite to that of FIG. 8.
Figure 10:
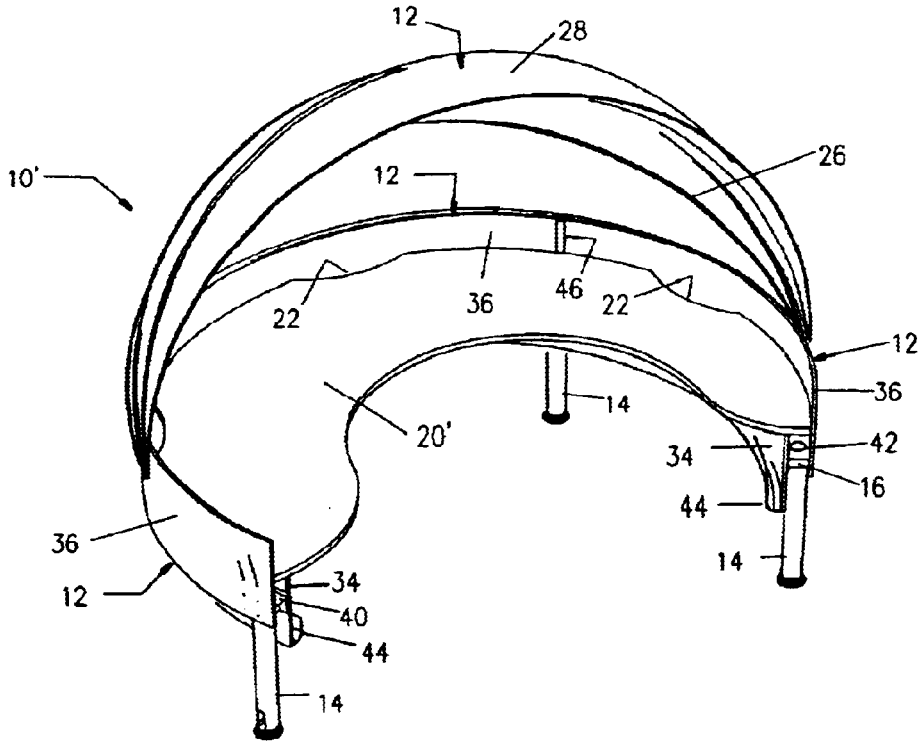
FIG. 10 is a perspective view of a modular workstation according to the invention having fewer than a maximum number of arcuate bases, and having a retractable canopy thereon.
Figure 11:
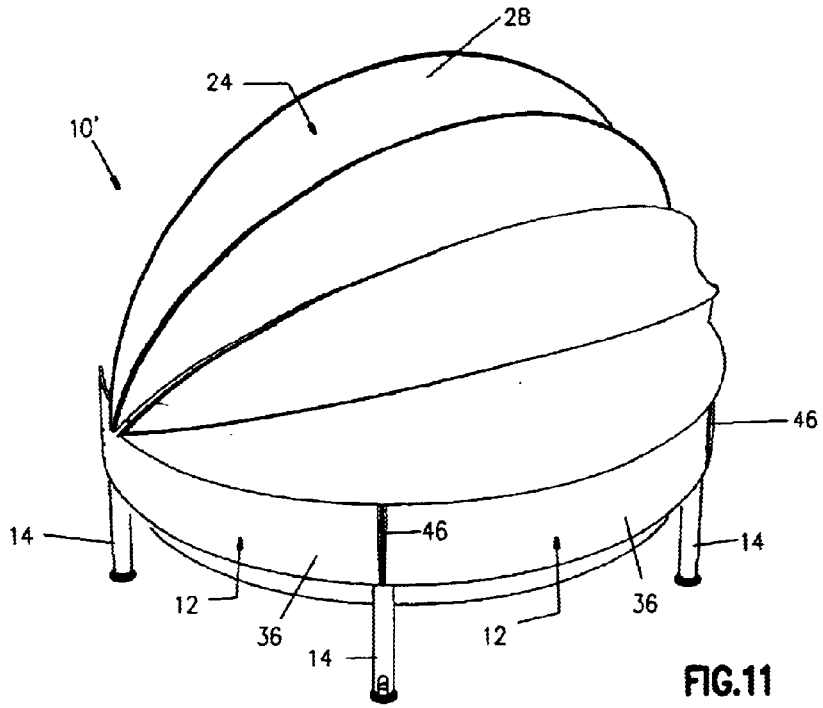
FIG. 11 is a perspective view similar to FIG. 10, but from the opposite side.
Figure 12:
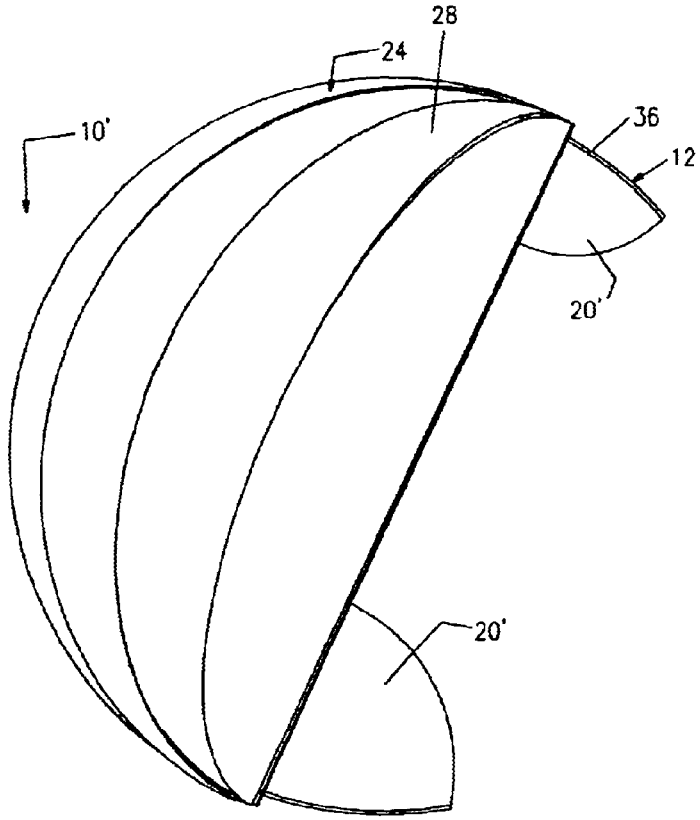
FIG. 12 is a top plan view of the modular workstation of FIGS. 10 and 11.
Figure 13:
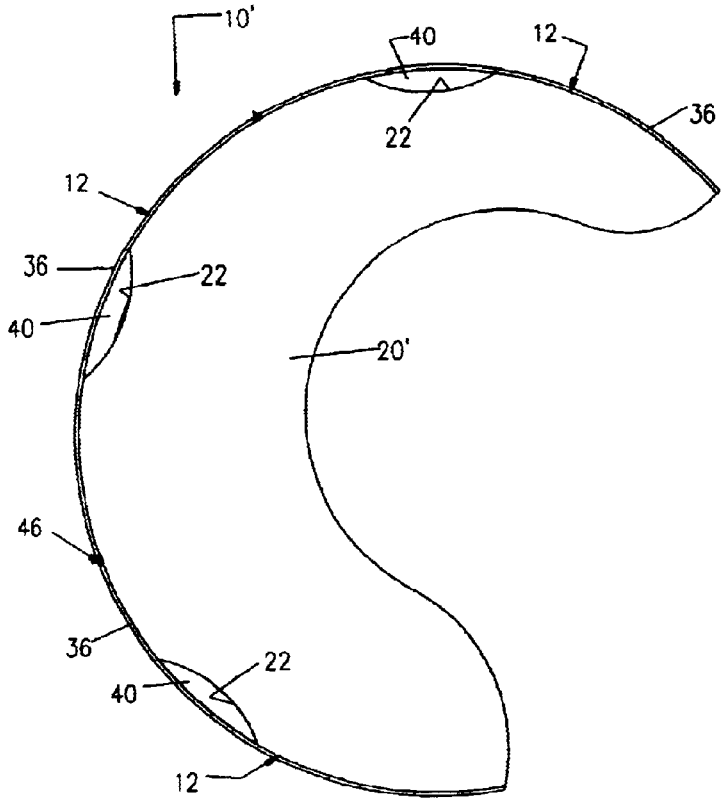
FIG. 13 is a top plan view of the modular workstation shown in FIG. 12, but without the retractable canopy.
Figure 14:
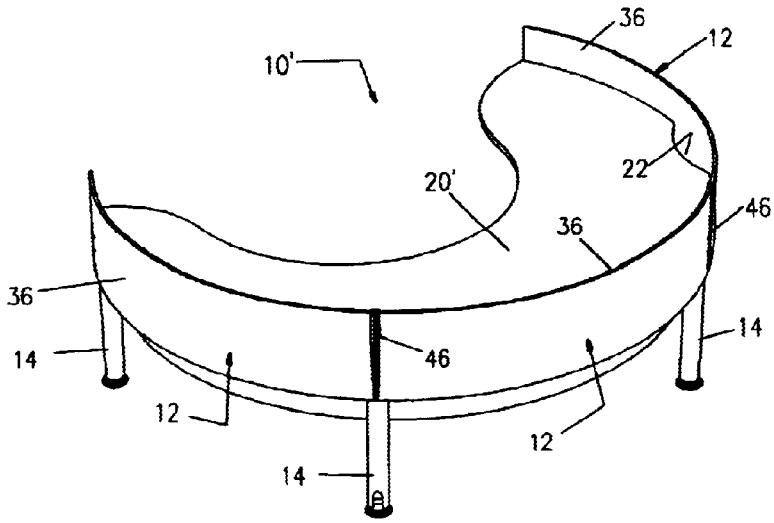
FIG. 14 is a rear perspective view of the modular workstation shown in FIG. 13.
Figure 15:
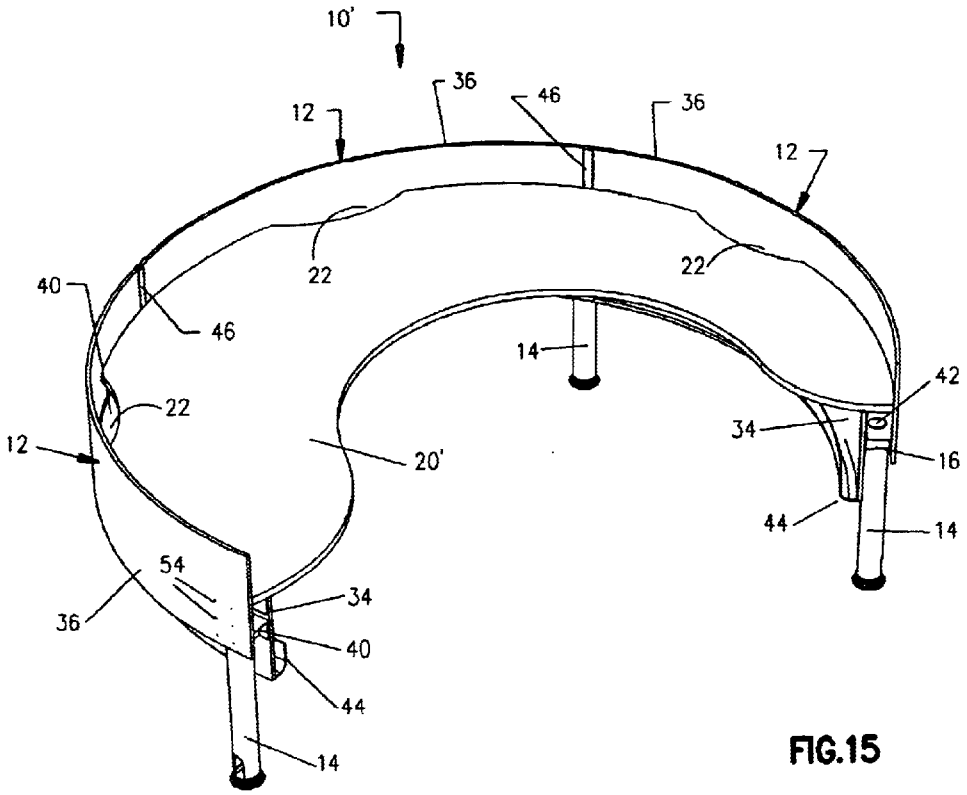
FIG. 15 is a front perspective view of the modular workstation shown in FIG. 13.
Figure 16:
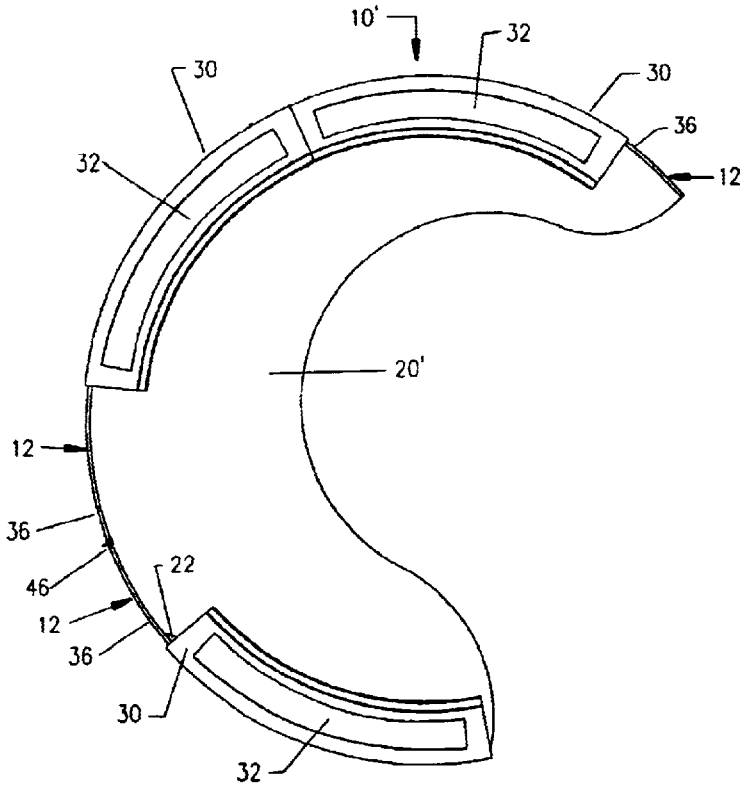
FIG. 16 is a top plan view of a modular workstation similar to that shown in FIGS. 13–15, but including three reference shelves.
Figure 17:
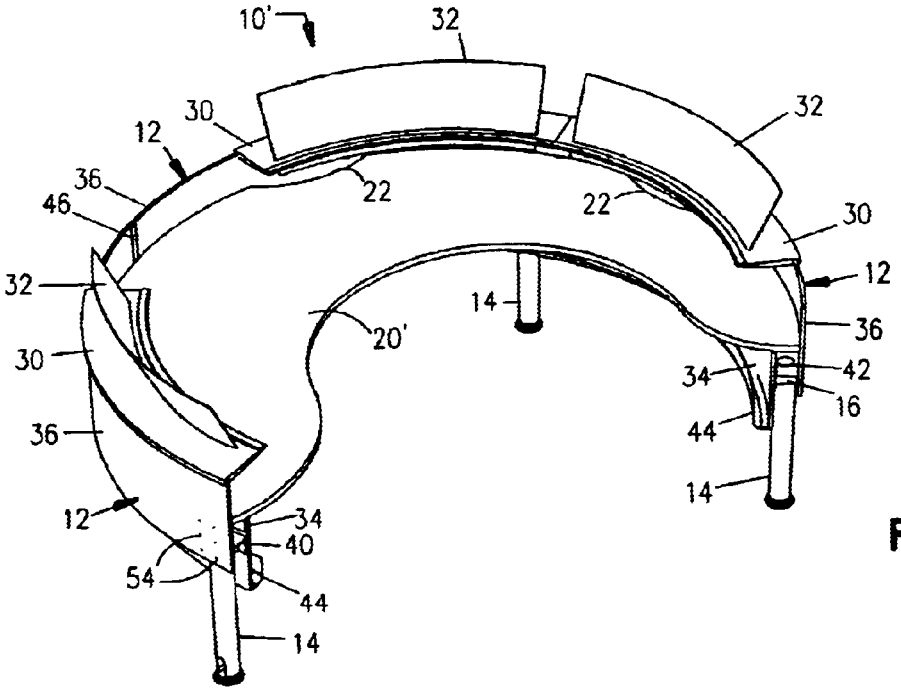
FIG. 17 is a front perspective view of the modular workstation shown in FIG. 16.
Figure 18:
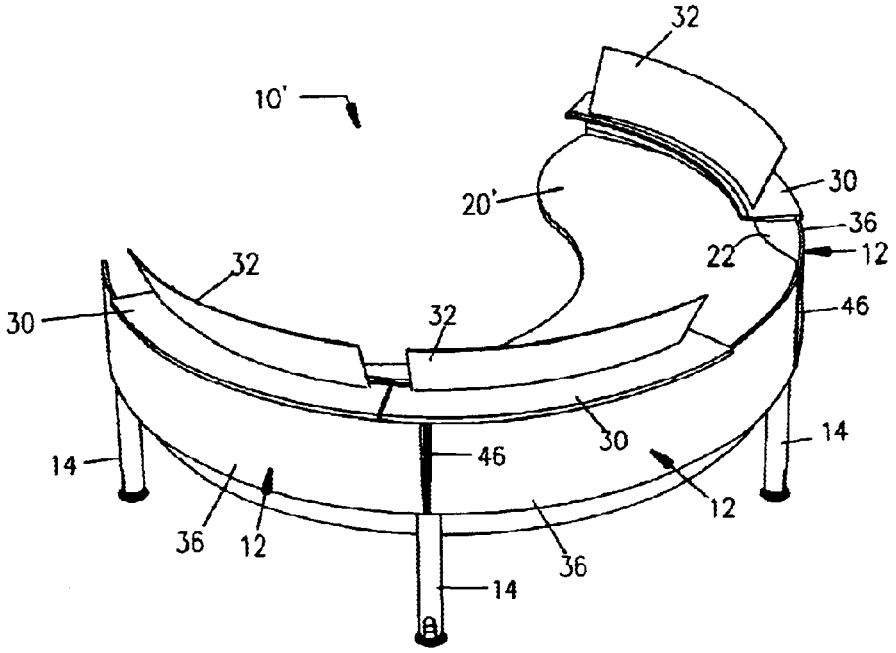
FIG. 18 is a rear perspective view of the modular workstation shown in FIG. 16.
Figure 19:
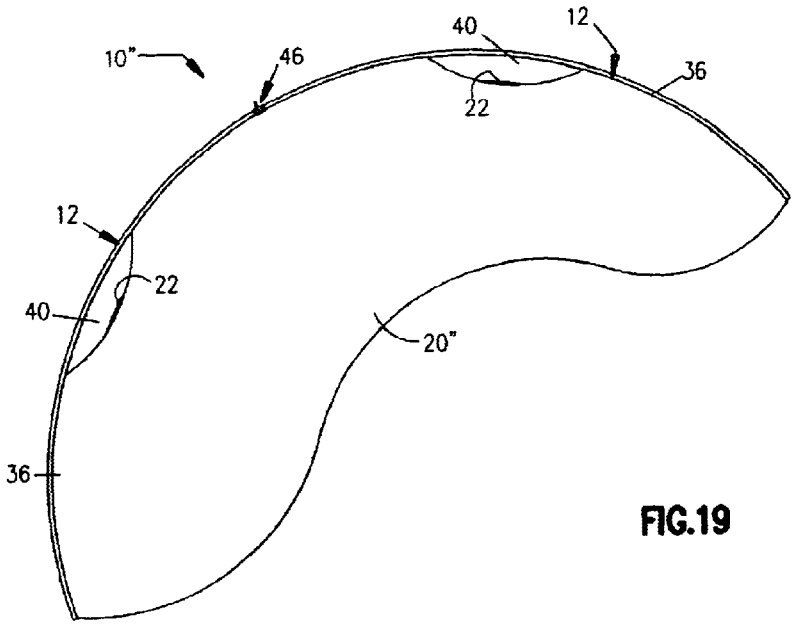
FIG. 19 is a top plan view of a further modular workstation according to the invention.
Figure 20:
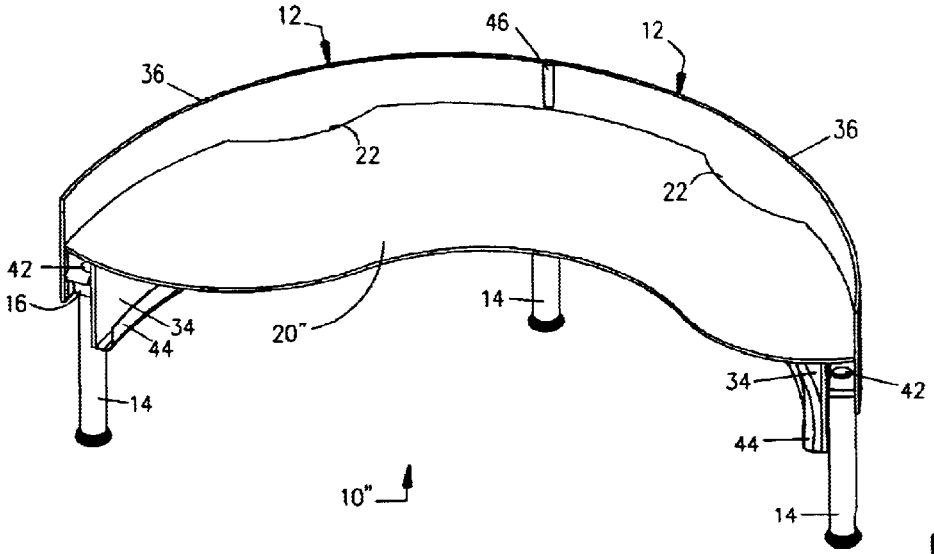
FIG. 20 is a front perspective view of the modular workstation shown in FIG. 19.
Figure 21:
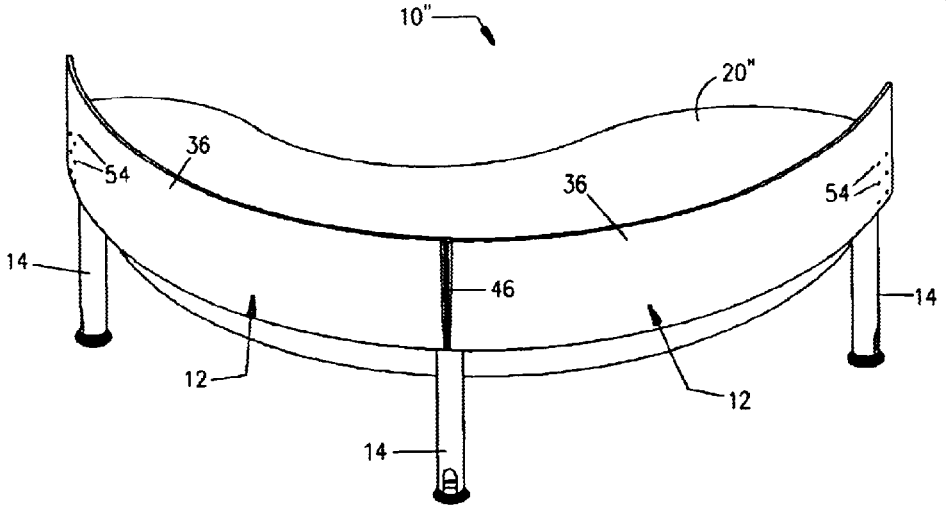
FIG. 21 is a rear perspective view of the modular workstation of FIG. 19.
Figure 22:
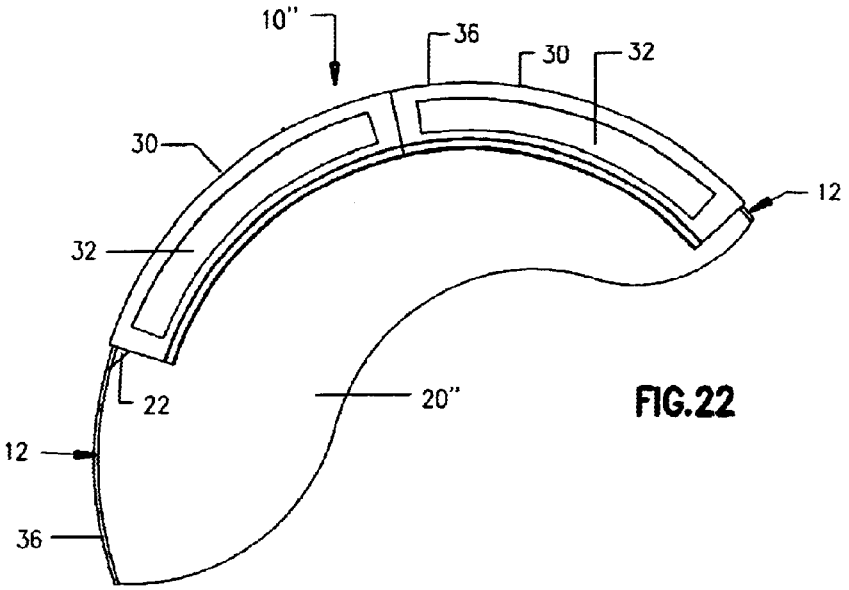
FIG. 22 is a top plan view of a modular workstation similar to FIG. 19, but including two reference shelves.
Figure 23:
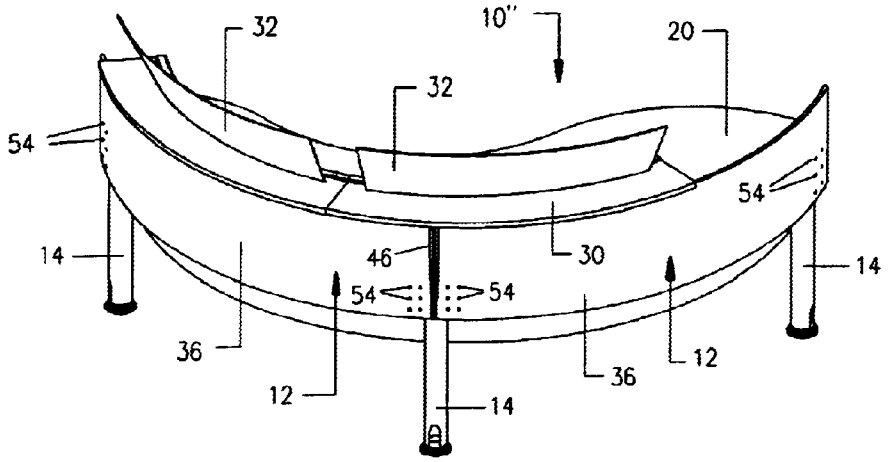
FIG. 23 is a rear perspective view of the modular workstation of FIG. 22.
Figure 24:
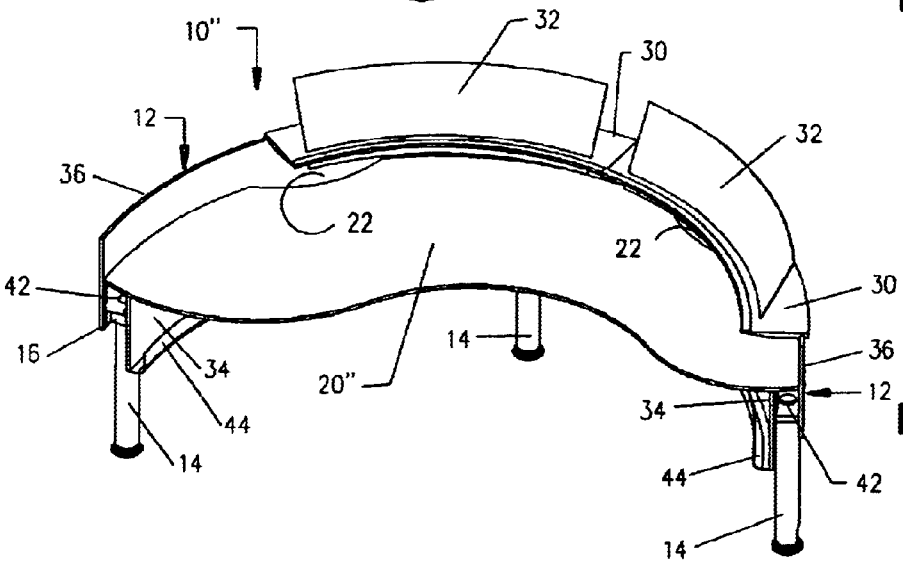
FIG. 24 is a front perspective view of the modular workstation of FIG. 22.
Figure 25:
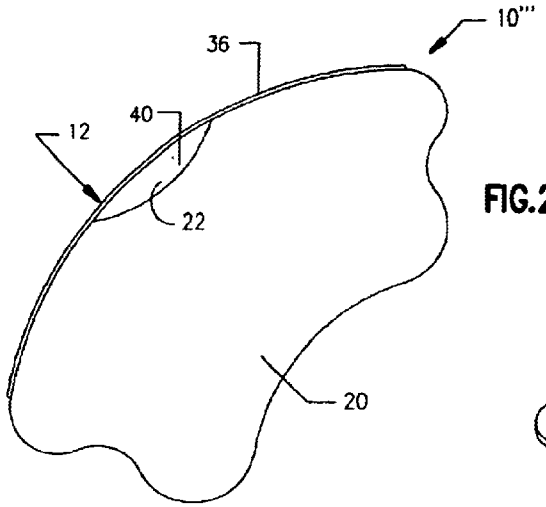
FIG. 25 is a top plan view of a modular workstation according to the invention comprising a single arcuate base.
Figure 26:
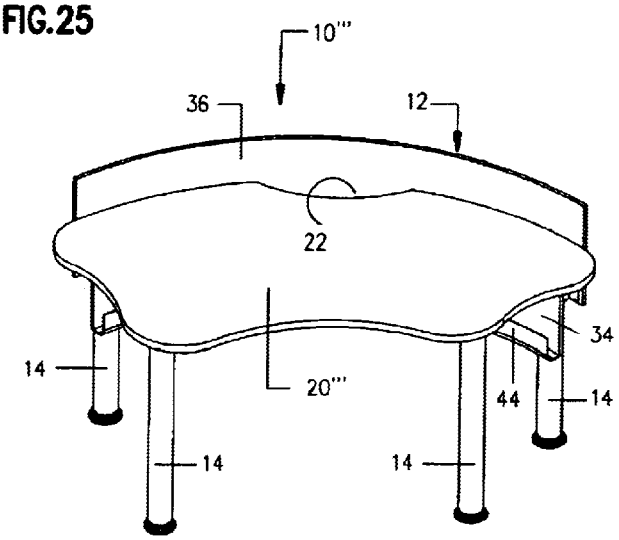
FIG. 26 is a front plan view of the modular workstation of FIG. 25.
Figure 27:
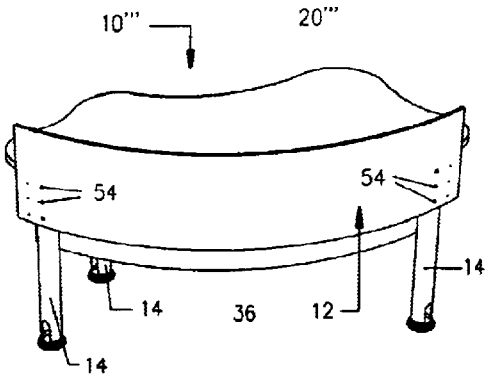
FIG. 27 is a rear plan view of the modular workstation of FIG. 25.
Figure 28:
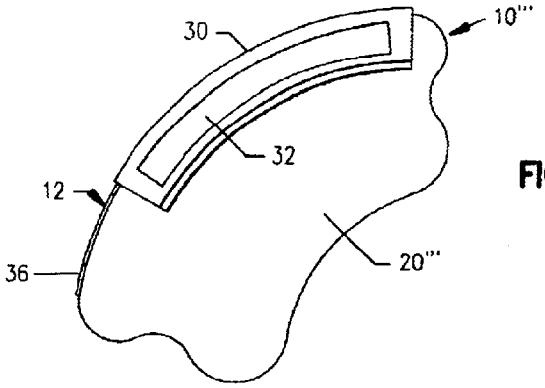
FIG. 28 is a top plan view of a modular workstation similar FIG. 25, but having a single reference shelf.
Figure 29:
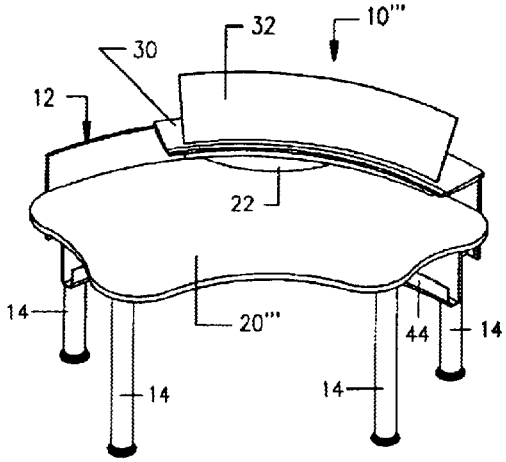
FIG. 29 is a front perspective view of the modular workstation of FIG. 28.
Figure 30:
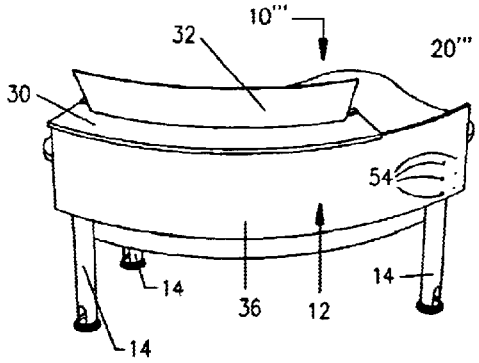
FIG. 30 is a rear perspective view of the modular workstation of FIG. 28.

Turning first to FIGS. 1 through 9, a modular workstation is shown generally at 10 in the drawing figures. The modular workstation 10 is composed of a plurality of abutting arcuate bases 12, in this case four of the arcuate bases 12, each comprising a module of 80°. Further details of each of the arcuate bases 12 are found below in relation to the discussion of the exploded view shown in FIG. 31.

The arcuate bases 12 are supported on a series of adjustable legs 14 mounted in a bracket 16 appropriately affixed to the modular workstation 10, as also described below in relation to the assembly view illustrated in FIG. 31.

The modular workstation 10 includes an opening 18 to permit access to the interior of the workstation 10. In the particular embodiment illustrated, the opening 18 is 40°, given that each arcuate base is a module of 80°.

The modular workstation 10 includes a horizontal worksurface 20. The worksurface 20 can be a single piece structure, or can be composed of a series of segments which are appropriately joined together to form a composite worksurface 20. The worksurface 20 may include one or more notches forming a utility access 22 for passage of cables, wires and other elements when the workstation 10 is in use.

The workstation 10 can be open to the surrounding environment, as generally depicted in FIGS. 5 through 9, or can include a canopy 24. The canopy 24 can be mounted to the arcuate base 12 in any conventional manner, and preferably is retractable. Accordingly, the canopy 24, as illustrated, includes a series of support ribs 26 and an overlying flexible material 28 that facilitates folding of the canopy 24 in a fan-like manner.

While the considerable surface area of the horizontal worksurface 20 is often adequate for most purposes, on occasion additional working area may be advantageous. One or more reference shelves 30 can be mounted on the abutting arcuate bases 12 in any conventional manner, and may or may not include an upright book rest 32. While each of the reference shelves 30 is shown extending to a smaller arcuate extent than each of the bases 12, it will be evident that the extent of the reference shelves 30 can be vary as desired. For modularity, however, it is preferred that the reference shelves 30 extend in length no greater than the arcuate length of the bases 12, and actually somewhat less, as illustrated.

The workstation 10, being modular, can include fewer of the arcuate bases 12. In FIGS. 10 through 18, a modified modular workstation 10' is illustrated, employing three of the arcuate bases 12 rather than four as illustrated in the earlier figures. All other elements of the invention are the same, and bear the same reference numerals, except that the horizontal worksurface 20' is also reduced in size to be accommodated in the smaller workstation 10'.

Similarly, an even smaller workstation 10" is illustrated in FIGS. 19 through 24. Again, all identical elements bear the same reference numerals and are as previously described, with the exception of the horizontal worksurface 20", which, again, is smaller to accommodate the reduced size of the workstation 10".

The workstations 10, 10' and 10" are constructed of the same arcuate bases 12, and as can be seen from the drawing figures, employ only a minimum of the legs 14. Preferably, the maximum number of legs is no greater than the number of arcuate bases, plus one. With the legs 14 set back from the horizontal worksurfaces 20, 20' and 20", the user of the modular workstations 10, 10' and 10" is uninhibited by obstructions when using the workstation.

A modular workstation 10'", using only one of the arcuate bases 12, is illustrated in FIGS. 25 through 30. In this form of the invention, a relatively smaller horizontal worksurface 20" is employed, and given the relatively limited extent of the single arcuate base 12, additional legs 14, appropriately affixed to the underside of the horizontal work surface 20", are employed.

Figure 31:
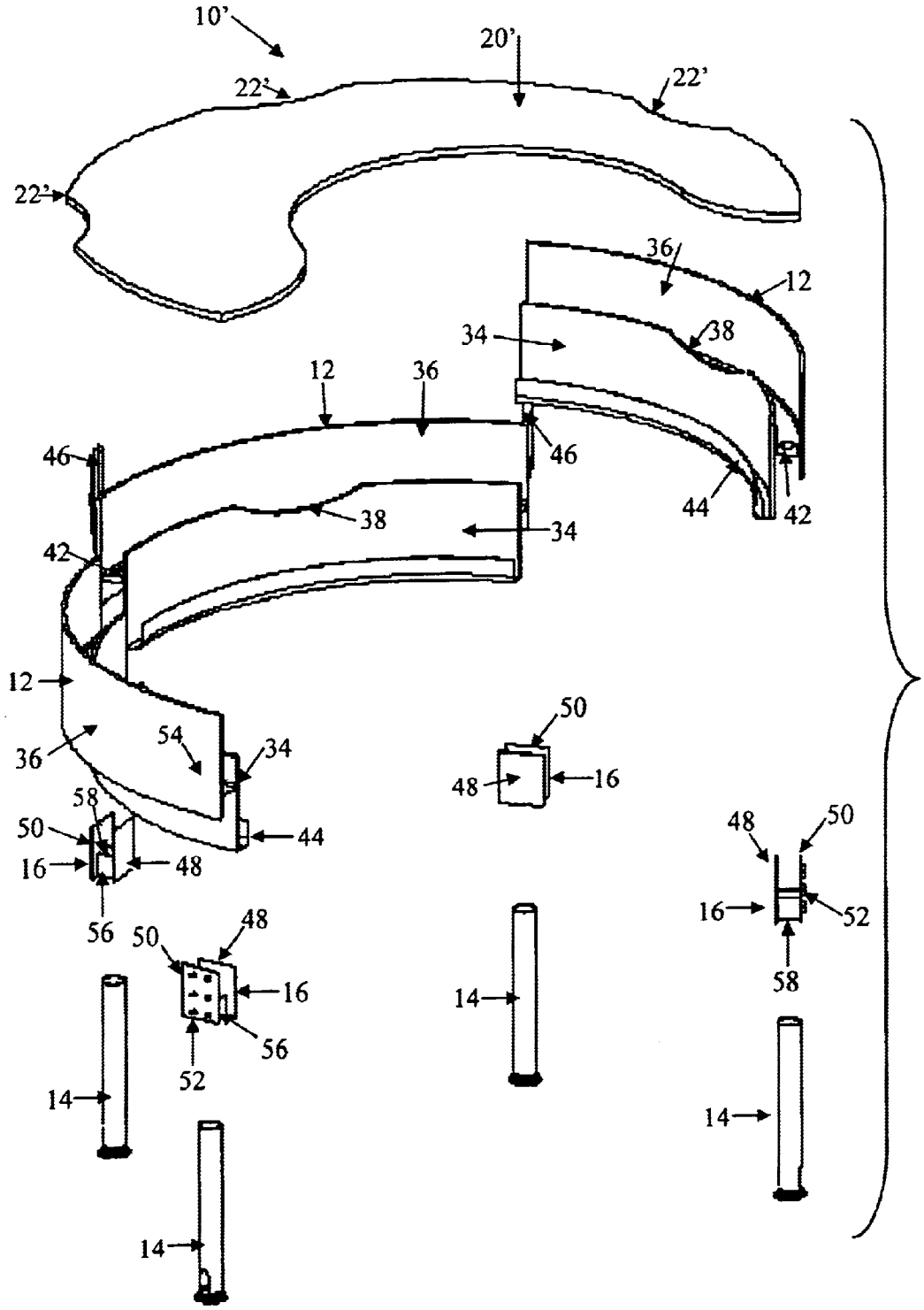
FIG. 31 is an exploded perspective view of the components of the modular workstations according to the invention.

FIG. 31 is an exploded assembly view of the elements of the modular workstations 10, 10' and 10" and 10'", in this case actually illustrating the modular workstation 10'. As explained previously, the only basic differences between the workstations, in addition to the number of arcuate bases 12, is the extent of the horizontal worksurface 20, 20' etc.

Each of the arcuate bases 12 comprises a pair of spaced, parallel inner and outer panel segments 34 and 36. The panel segments 34 and 36 are oriented generally vertically, and the inner panels segment 34 is offset in relation to the outer panel segment 36. Each of the inner panel segments 34 is notched with a utility access 38, in the same manner that the horizontal worksurfaces 20 are notched.

The inner and outer panel segments 34 and 36 are separated by, and connected to, a web 40. Not only does the web join the panel segment 34 and 36 to form a unitary body, but also the web 40 orients the panels 34 and 36 relative to one another so that, as illustrated in the various drawing figures, the horizontal worksurfaces 20, 20', 20", and 20'" are supported on the inner panel segments 34 and abut the outer panel segments 36. The horizontal worksurfaces can be appropriately affixed to the arcuate bases 12 in any conventional manner.

Each of the webs 40 includes one or more aperatures in the form of a utility access 42 for cables, wires and other elements, as appropriate. The number of the utility accesses 42 in each of the arcuate basis 12 can be selected as desired.

Each of the inner panel segments 34 includes a utility channel 44 proximate the lower edge of the panel segment 34. The utility channel 44 can provide a rest and guide for cables, wires and the like, or can be used as a support for anything mounted on the inner panel segment 44 and extending therebeneath.

The arcuate bases, when assembled one to the other, are butted with the outer panel segments 36 adjacent one another. To provide a cleaner juncture between adjacent pairs of arcuate bases 12, a removable trim clip 46 is provided to cover the junction between adjacent outer panel segments 36.

Preferably the brackets 16 are used to join adjacent arcuate basis 12. The brackets 16 are composed of spaced inner and outer plates 48 and 50, with the outer plates 50 having a series of holes 52 which align with holes 54 in the outer panel segments 36. Only some of the holes 54 in the outer panel segments 36 are illustrated in the drawing figures.

The legs 14 are inserted in the brackets 16, being sandwiched between the inner and outer plates 48 and 50 and opposite spacers 56 and 58. The spacing between the plate 48 and 50 and spacers 56 and 58 is such that there is a jam fit of the legs 14 when installed in the brackets 16. Other fasteners could be used, also, in a conventional manner.

Two vertical columns of the holes 54 are located in each end of the outer panel segments 36 as illustrated. The brackets 16 bridge adjacent pairs of the arcuate bases 12, and bolts or appropriate fasteners are inserted through the outer columns of the holes 54 and into the corresponding holes 52 in the brackets 16. Thus, adjacent arcuate bases 12 are firmly connected one to the other. Any vacant holes can be filled with appropriate plugs.

When a bracket 16 is mounted at an open end of the modular workstation 10, the holes 52 are aligned with the two columns of holes 54 and fasteners are inserted. The brackets 16 thus do not extend beyond the extent of the outer panel segments of the arcuate bases 12, as illustrated in the various perspective views.

When a full extent of the modular workstation is employed, such as the workstation 10 of FIGS. 1–9, the structure is penannular. This form of the invention also is the most stable given its almost complete annulus.

Various changes can be made to the invention without departing from the spirit thereof or scope of the following claims.

What is claimed is:

1. A modular workstation, comprising a. an arcuate base comprising a pair of spaced, parallel inner and outer panel segments, the panel segments being oriented generally vertically, and the inner panel segment being offset in relation to the outer panel segment, b. a web extending between the panel segments, the panel segments and the web comprising a unitary body, c. a generally horizontal worksurface supported on said inner panel segment and abutting said outer panel segment, d. a plurality of legs supporting said base and said worksurface and, e. means securing said legs to said base and said worksurface.

2. The modular workstation according to claim 1, in which said securing means for said legs to said base comprises a bracket for each leg, said bracket being secured to said outer panel segment and being shaped for insertion of said leg.

3. The modular workstation according to claim 1, including a utility channel proximate a lower edge of said inner panel segment.

4. The modular workstation according to claim 1, including a reference shelf spaced above said worksurface, said reference shelf being mounted on said outer panel segment.

5. The modular workstation according to claim 1, including a utility access in at least one of said worksurface, said inner panel segment and said web.

6. A modular workstation, comprising a. a plurality of abutting arcuate bases, each arcuate base comprising i. a pair of spaced, parallel inner and outer panel segments, the panel segments being oriented generally vertically, and the inner panel segment being offset in relation to the outer panel segment, and ii. a web extending between the panel segments, the panel segments and the web comprising a unitary body, b. a generally horizontal worksurface supported on said inner panel segments and abutting said outer panel segments, c. means joining said abutting arcuate bases, d. a plurality of legs supporting said bases and e. means securing said legs to said acute bases.

7. The modular workstation according to claim 6, in which the number of said legs is no greater than the number of said arcuate bases, plus one.

8. The modular workstation according to claim 6, in which said joining means comprises a bracket bridging butting arcuate bases, said bracket being secured to said outer panel segments of said butting arcuate bases.

9. The modular workstation according to claim 8, in which said bracket is shaped for insertion of a said leg, said bracket comprising said securing means.

10. The modular workstation according to claim 6, including a utility channel proximate a lower edge of each inner panel segment.

11. The modular workstation according to claim 6, including at least one reference shelf spaced above said worksurface, said reference shelf being mounted on said outer panel segments.

12. The modular workstation according to claim 6, including a utility access in at least one of said worksurface, said inner panels and said webs.

13. The modular workstation according to claim 6, including a trim clip mounted at adjoining outer panel segments of each pair of abutting arcuate bases.

14. The modular workstation according to claim 6, in which said plurality of abutting arcuate bases is penannular.

15. The modular workstation according to claim 6, including a canopy mounted on said outer panel segments.

16. The modular workstation according to claim 15, in which said canopy is retractable.

* * * * *